US005797448A

United States Patent [19]

Hughes et al.

[11] Patent Number: 5,797,448

[45] Date of Patent: Aug. 25, 1998

[54] HUMPED PLATE FIN HEAT EXCHANGER

[75] Inventors: Gregory G. Hughes, Milwaukee; Brian P. Gilner, Sturtevant, both of Wis.

[73] Assignee: Modine Manufacturing Co., Racine, Wis.

[21] Appl. No.: 734,881

[22] Filed: Oct. 22, 1996

[51] Int. Cl.[6] ..... F28D 1/053

[52] U.S. Cl. ..... 165/151; 165/906

[58] Field of Search ..... 165/150, 151, 165/181, 182, 906

[56] References Cited

U.S. PATENT DOCUMENTS

| | | | |
|---|---|---|---|
| 1,557,467 | 10/1925 | Modine | 165/151 |
| 1,927,325 | 9/1933 | Ritter | 165/151 |
| 2,983,483 | 5/1961 | Modine | 165/151 X |
| 3,515,207 | 6/1970 | Lu . | |
| 3,902,551 | 9/1975 | Lim et al. | 165/151 X |
| 4,428,419 | 1/1984 | Dubrovsky et al. . | |
| 4,434,846 | 3/1984 | Lu . | |
| 4,449,581 | 5/1984 | Blystone et al. . | |
| 4,550,776 | 11/1985 | Lu . | |
| 4,586,563 | 5/1986 | Dubrovsky et al. | 165/151 |
| 4,592,420 | 6/1986 | Hughes | 165/151 |
| 4,715,437 | 12/1987 | Tanaka et al. | 165/151 |
| 4,984,626 | 1/1991 | Esformes et al. | 165/151 |
| 5,111,876 | 5/1992 | Nash . | |
| 5,201,367 | 4/1993 | Dubrovsky et al. . | |
| 5,203,403 | 4/1993 | Yokoyama et al. . | |
| 5,207,270 | 5/1993 | Yokoyama et al. . | |

FOREIGN PATENT DOCUMENTS

| | | | |
|---|---|---|---|
| 2756941 | 6/1979 | Germany | 165/182 |

*Primary Examiner*—Leonard R. Leo

*Attorney, Agent, or Firm*—Wood, Phillips, VanSanten, Clark & Mortimer

[57] ABSTRACT

A plate fin heat exchanger having a plurality of tubes generally perpendicular to and extending through a stack of humped plate fins. The plate fins have a plurality of holes to receive the tubes. These holes are disposed in rows, and are defined by wrinkle free collars surrounding the holes. A number of trapezoidal stiffening beads both short and long are integral to the plate and are disposed between the rows of holes. The rows of holes coincide with rows of arced humps in the plate fins.

8 Claims, 7 Drawing Sheets

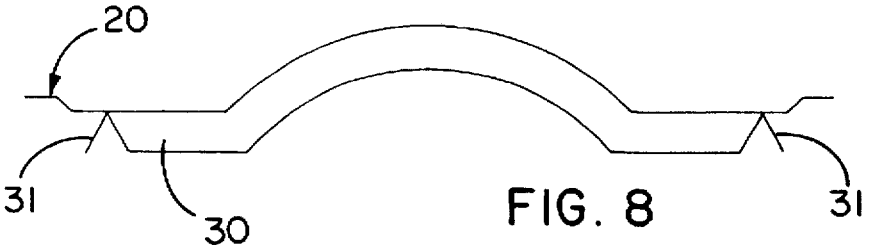
FIG. 8
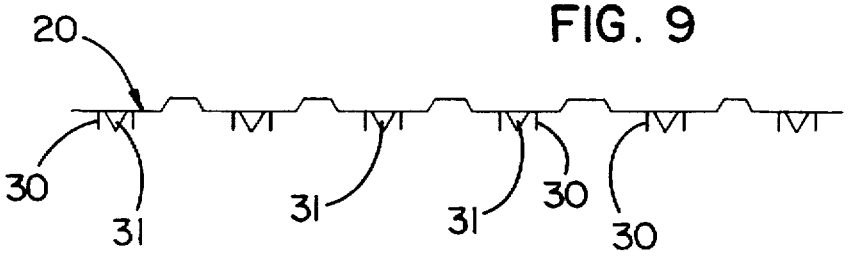
FIG. 9
FIG. 13
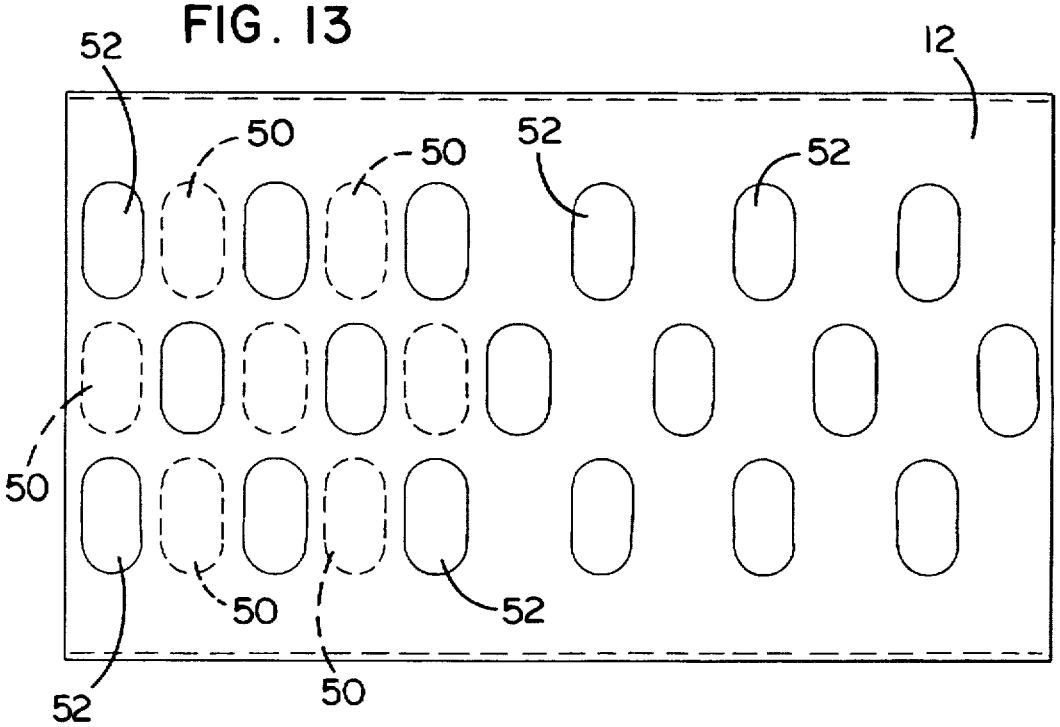

HUMPED PLATE FIN HEAT EXCHANGER

BACKGROUND OF THE INVENTION

The present invention is directed toward a plate fin heat exchanger, and more particularly, to a humped plate fin utilized in such heat exchangers.

BACKGROUND ART

Plate fin heat exchangers are well known. Generally they include a core made up of a number of stacked plates spaced in a parallel relationship. The plates have aligned holes through which tubes extend generally perpendicular to the plane of the plates. The tubes are interconnected and carry a first fluid through the heat exchanger. A second fluid, usually air, flows between the stacked plates. Heat transfer occurs between these fluids by heat transfer through the fins and across the tubes.

Increased heat transfer has been achieved by maximizing the surface area of the plate fins exposed to the fluid surrounding the plate fins and by increasing the turbulence of this fluid. This has been implemented by introducing indentations and corrugations to a plate fin 10, as seen in FIG. 1. FIG. 2 shows the prior art corrugations 11. This manner of increasing surface area introduces a number of drawbacks that may decrease plate fin performance. These drawbacks include the increased flimsiness of the plate fin 10 in one plane due to the corrugations 11, the increased susceptibility to damage during core construction, and the greater likelihood of forming an uneven core. Each of these drawbacks can increase production costs and/or decrease heat exchanger efficiency.

Another factor affecting heat exchange performance is the connection between the tubes and fins. A tight tube-fin connection increases heat exchanger performance. A good tube to fin bond, such as a good soldered or brazed joint, is therefore highly desirable.

In many plate fin heat exchangers, tubes 12 are pushed through aligned tube holes 13 in the plates. Once in place, the tubes are mechanically expanded by driving a so-called "bullet" or expanding mandrel through each tube. As a result, the tube side walls are inelastically urged into close proximity to the surrounding fin enabling the formation of an excellent bonded joint. Excellent heat transfer will then exist across the fin-tube interface.

In some cases, however, tube expansion is impractical or even impossible. For example, in prior art multiple row heat exchangers having hundreds of tubes 12, it simply is not practical to expand the tubes because of the large number of them. And when the tubes have dimpled surfaces or are otherwise provided with internal turbulators or strengthening webs, a bullet cannot be driven through them without flattening out the dimples, destroying the turbulator effect they provide or breaking the webs destroying the strength against internal pressure that they provide. Consequently other solutions have been attempted to achieve the close proximity necessary to assure a good brazed or soldered tube to a fin joint.

For example, prior art plate fin holes may be partially or wholly surrounded by a collar 14. The prior art collars 14 shown in FIG. 3 are wrinkled where the collars 14 meet the fin 10. These wrinkles 15 prevent the collars 14 of the plate fin 10 from making complete peripheral contact with the tubes 12, which can result in decreased heat exchanger core performance as a result of the absence of solder or braze metal where contact is lost.

For these and other reasons, the current state of heat exchanger performance for a given size, weight and production cost is not totally satisfactory.

This invention is directed to overcome one or more of the above problems.

SUMMARY OF THE INVENTION

In one aspect of the present invention a plate fin heat exchanger is disclosed having a plurality of tubes and plate fins, each plate fin having a plurality of arced deformations extending in at least two spaced rows with a plurality of tube holes disposed therein. The plate fin also has a plurality of stiffening beads of trapezoidal cross-section disposed between the arced deformations.

It is an object of the invention to provide a heat exchanger that can be substituted for a prior art heat exchanger of a given size, and have greater heat transfer performance than the prior art unit.

It is also an object of the invention to provide a heat exchanger of a given size and performance level having a lower weight than the substitutable prior art heat exchanger.

It is a further object of the invention to provide a plate fin heat exchanger wherein the collars surrounding the tube holes of the plate fins have less wrinkling than the prior art plate fins.

It is also a further object of the invention to provide a manufacturer with a variety of choices of new core construction to replace cores constructed of the prior art plate fins.

It is a still further object of this invention to provide a plate fin heat exchanger constructed of plate fins having an increased surface area without suffering a loss of fin stiffness.

BRIEF DESCRIPTION OF THE DRAWINGS

FIG. 8 is an enlargement of one collar as shown in FIG. 6.

FIG. 9 is a cross-sectional view approximately along the line 9—9 in FIG. 5.

FIG. 13 is a fragmented plan view of a dimpled tube.

DESCRIPTION OF THE PREFERRED EMBODIMENT

It is to be understood that the present invention is not limited to the particular heat exchanger set forth below, and that the dimensions set forth below are for purposes of illustration and enablement only.

Figure 4:
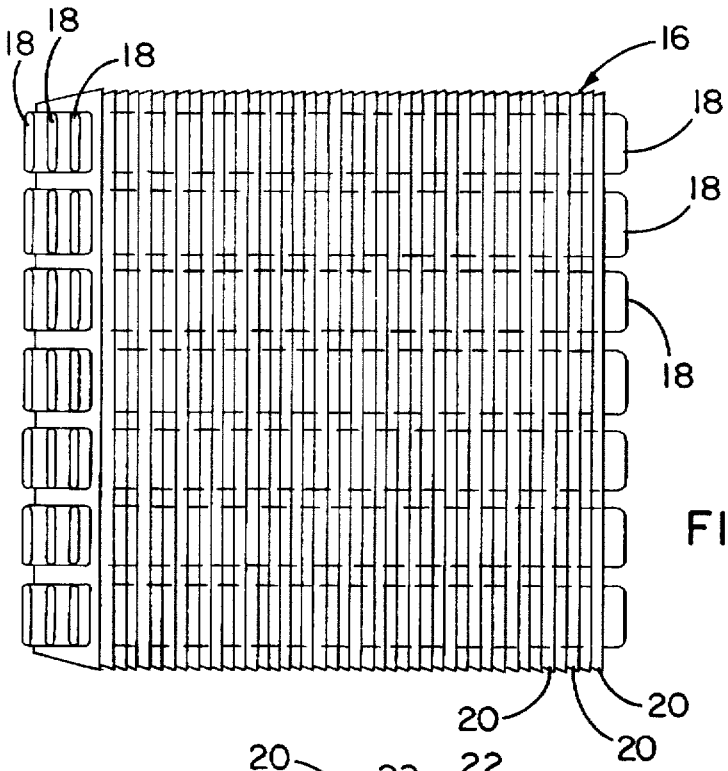
FIG. 4 is a view of a heat exchanger core made according to the invention.

One embodiment of a heat exchanger 16 contemplated by the current invention is shown in FIG. 4 and has a core which includes a plurality of tubes 18 extending through a number of stacked plate fins 20. The tubes 18 are placed in communication with each other by headers and tanks (not shown) to form a pathway through the tubes 18 having an inlet which receives the first fluid from a source and an outlet which delivers the first fluid from the tubes 18 to a destination outside the heat exchanger.

In one embodiment, the tubes 18 have a major dimension of 0.625" (⅝") and a minor dimension of 0.076" and can be smooth tubes or turbulated tubes with 0.014" high dimples. However, those skilled in the art will readily recognize that other dimensions may be used as desired. The tubes 18 are parallel to each other and extend through several stacked plate fins 20 generally perpendicular thereto. The tubes 18 will typically have dimples (not shown) in their side walls. The dimples extend toward the center of the tube and induce turbulence in the first fluid flowing therein. The increased turbulence, of course, improves heat transfer as is well known. It should be recognized, however, that plain tubes, that is, tubes without dimples, may be used as well and are specifically contemplated for use in one form of the invention.

Figure 5:
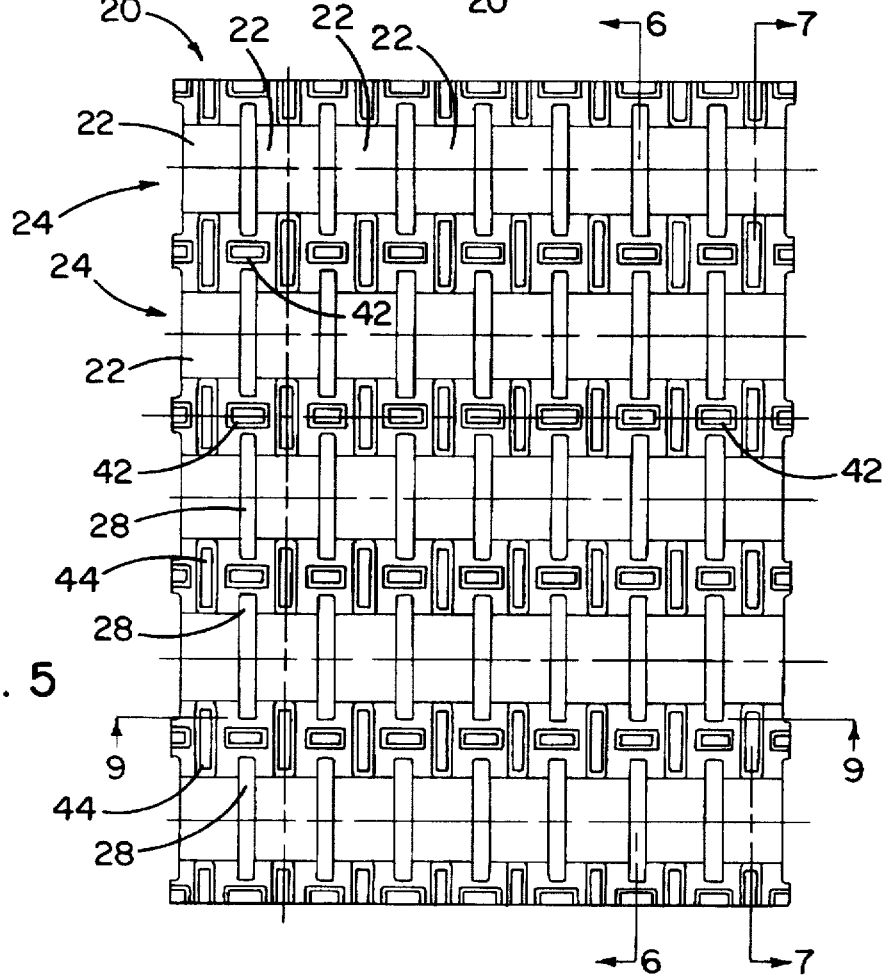
FIG. 5 is a plan view of a plate fin made according to the invention.

The plate fins are humped plate fins 20 and are made of copper sheeting, approximately 0.003" thick, and have several arced deformations 22 aligned in equally spaced rows 24 extending across the entire plate fin 20 surface (FIG. 5). The arced deformations 22 are humps formed by a rolling and/or stamping process, and have a 0.3125" radius to a center point and a high-point 0.076" above the plane of the plate fin 20 (FIG. 6).

The tube holes 28 are disposed at regular intervals within the arced rows 24. The tube holes 28 are spaced 0.3853" apart, and are sized similar to the corresponding tubes 18 to ensure a tight fit. In FIG. 5, each tube hole 28 has a major dimension measuring 0.6300±0.0020" and a minor dimension measuring 0.080±0.0020". The plate fin-tube connection is a tight fit, wherein a collar 30 of the plate fin 20 is substantially flush to the tube 18. That is to say, peripheral contact of each tube 18 within hole 28 and the collar 30 is desired.

Figure 6:
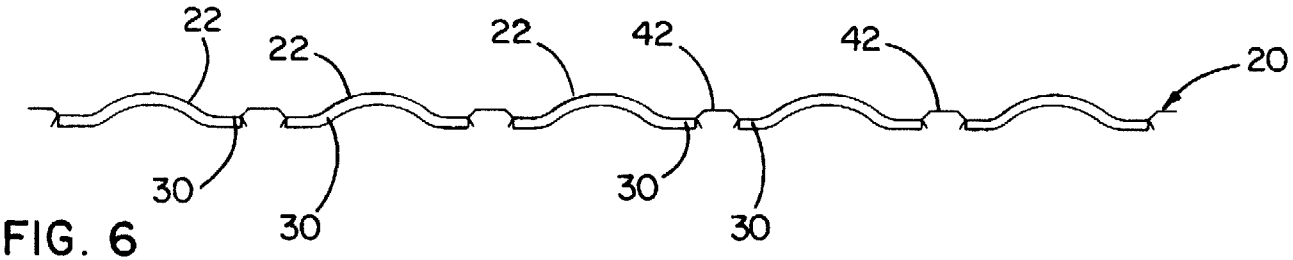
FIG. 6 is a cross-sectional view of the line 6—6 in FIG. 5.

The tube holes 28 are formed by rolling a stamping die along the plate fin 20 to stamp a tube hole 28 and a surrounding collar 30 as shown in FIG. 6. During the stamping process, a portion of plate fin 20 is bent from the plane of the plate fin 20 and acts as the collar 30. The collar 30 is essentially wrinkle-free and extends along all sides of the opening 28. Along the opening's major axis sides, the collar 30 follows the contour of the arced row 24, as shown in FIG. 8. The minor axis portion 31 of the collar 30 extends downward from the plane of the plate fin 20 in a generally triangular shape, substantially perpendicular to the general plane of the plate fin 20, as shown in FIG. 9.

Figure 7:
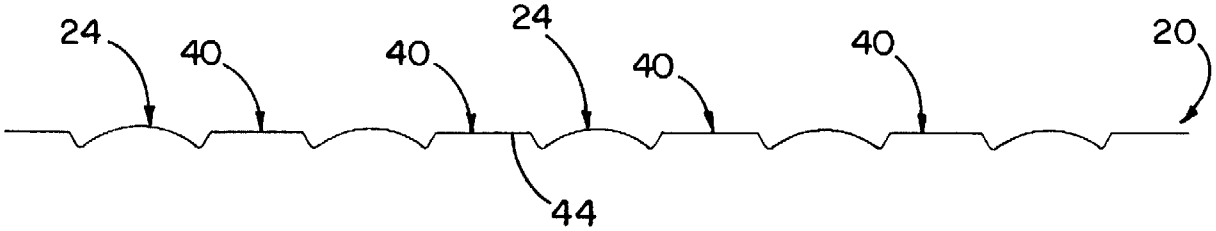
FIG. 7 is a cross-sectional view of the line 7—7 in FIG. 5.

A series of pyramidal shaped stiffening beads of trapezoidal cross section are disposed between the arced rows 24 in the plate fin 20. Short stiffening beads 42 and long stiffening beads 44 are disposed in rows 40 between the arced rows 24 and extend above the plate fin 20 plane 0.0160+0.0020". Short stiffening beads 42 have a 0.0880×0.2473" rectangular base and a 0.1993"×0.0400" cap. Long stiffening beads 44 have a 0.3389"×0.0780" base and a 0.2909"×0.0300" cap. Both long and short stiffening beads, 42 and 44, are laid out in rows 40 between the arced rows 24 (FIG. 7). The long stiffening beads 44 extend lengthwise parallel to the major axis of the tube holes 18. The short stiffening beads 42 are disposed perpendicular to and between the long stiffening beads 44.

The tubes 18 are inserted through the plate fin 20 tube holes 28 as follows. First, several plate fins 20 are placed in a fin jig which holds them during core construction. The fins 20 are aligned such that corresponding tube holes 28 are aligned. Next, tubes 18 are pushed through the aligned tube holes 28 and inserted from the convex side of the humped fin. Due to the above-described sizing of the tube holes 28 and the tubes 18, a tight fit is obtained at the tube-plate fin connection. Forming the collars 30 around tube holes 28 set within the arced deformations 22 provides collars 30 that are substantially wrinkle-free. This allows the collar 30 to be disposed in continuous abutment with the tubes 18. This connection can increase heat exchanger core stability and improve heat exchange performance of cores having this construction.

Figure 1:
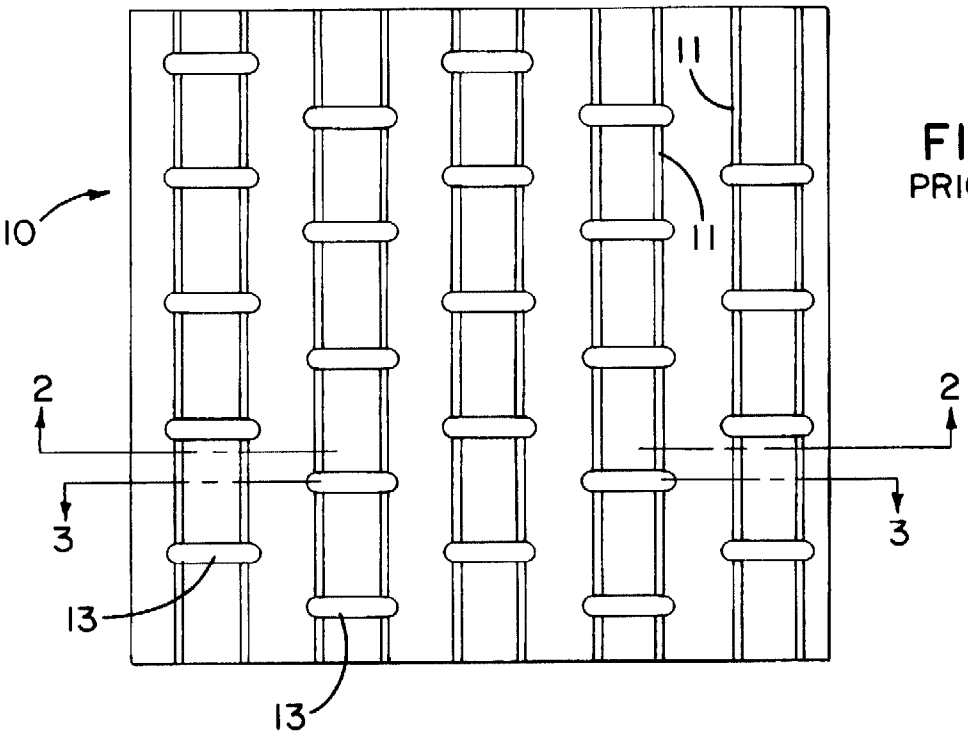
FIG. 1 PRIOR ART
FIG. 1 is a plan view of a commonly used prior art plate fin.
Figure 2:
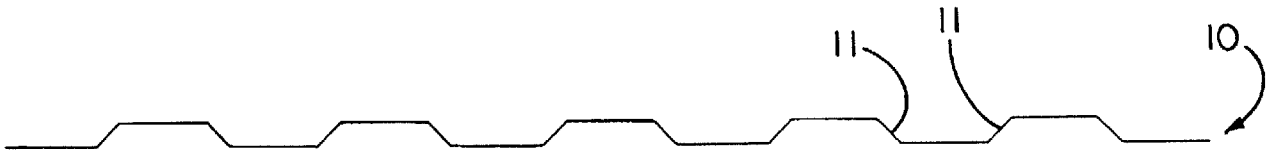
FIG. 2 PRIOR ART
FIG. 2 is a cross-sectional view approximately along the line 2—2 in FIG. 1.
Figure 3:
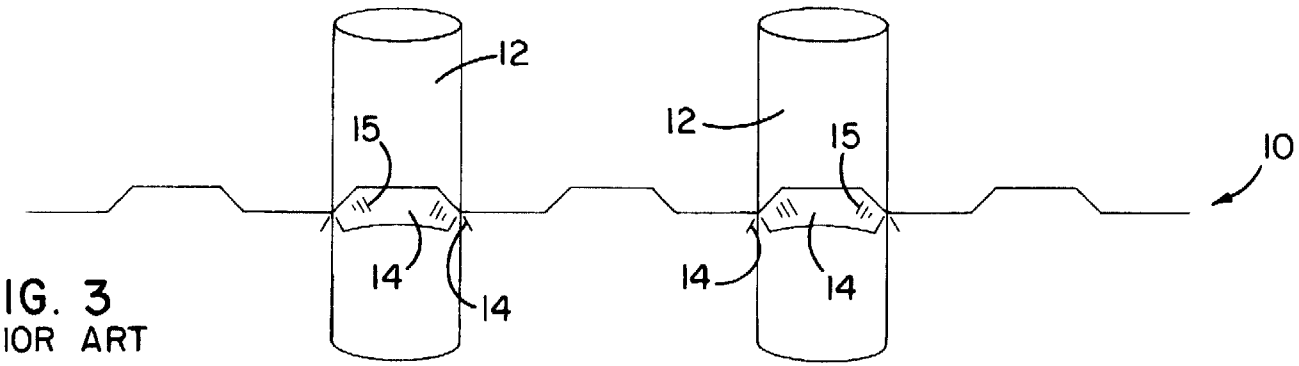
FIG. 3 PRIOR ART
FIG. 3 is a cross-sectional view approximately along the line 3—3 in FIG. 1.
Figure 10:
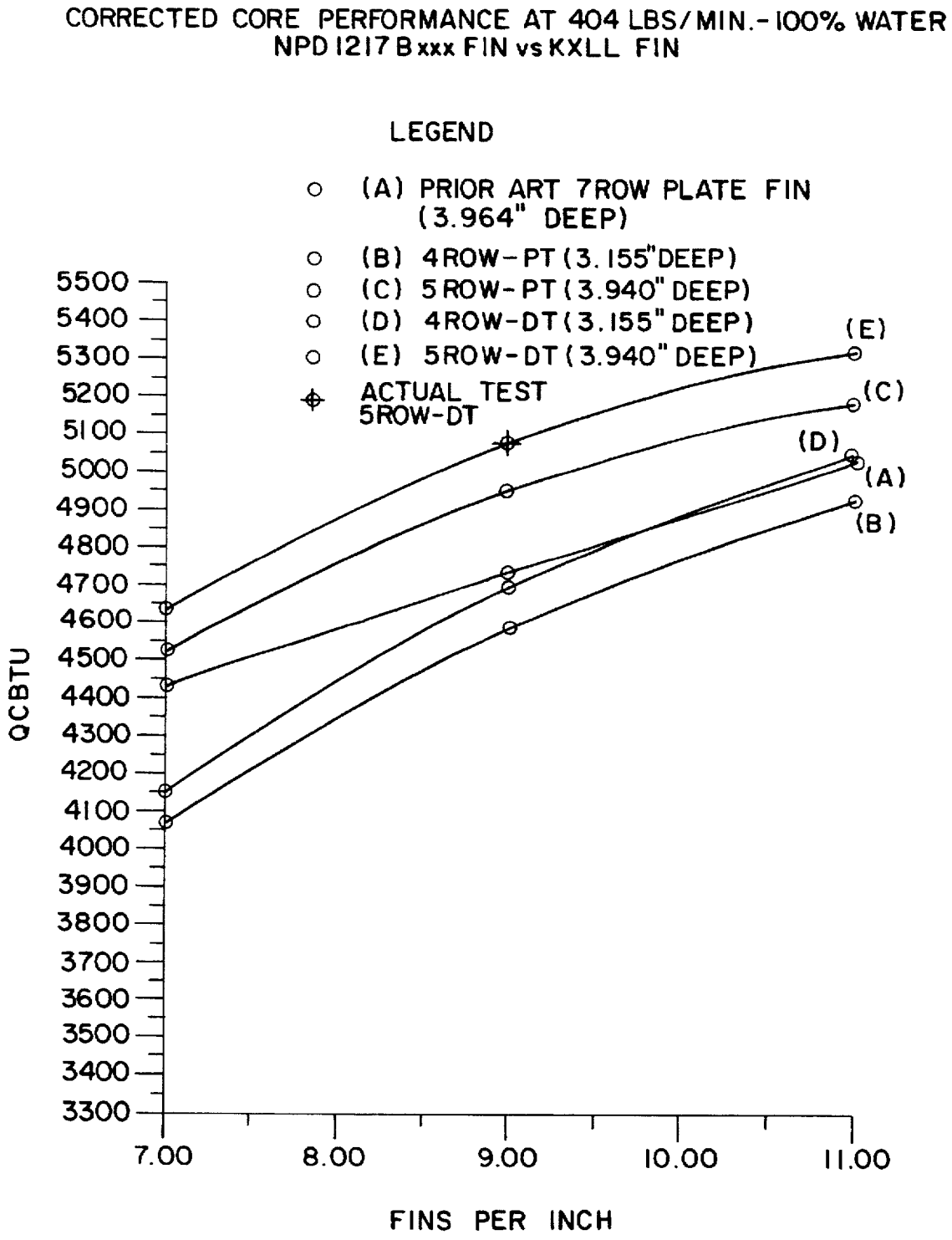
FIG. 10 is a graph comparing the overall heat exchanger performance of a variety of cores as the number of fins-per-inch vary, with water flowing through the tubes.
Figure 11:
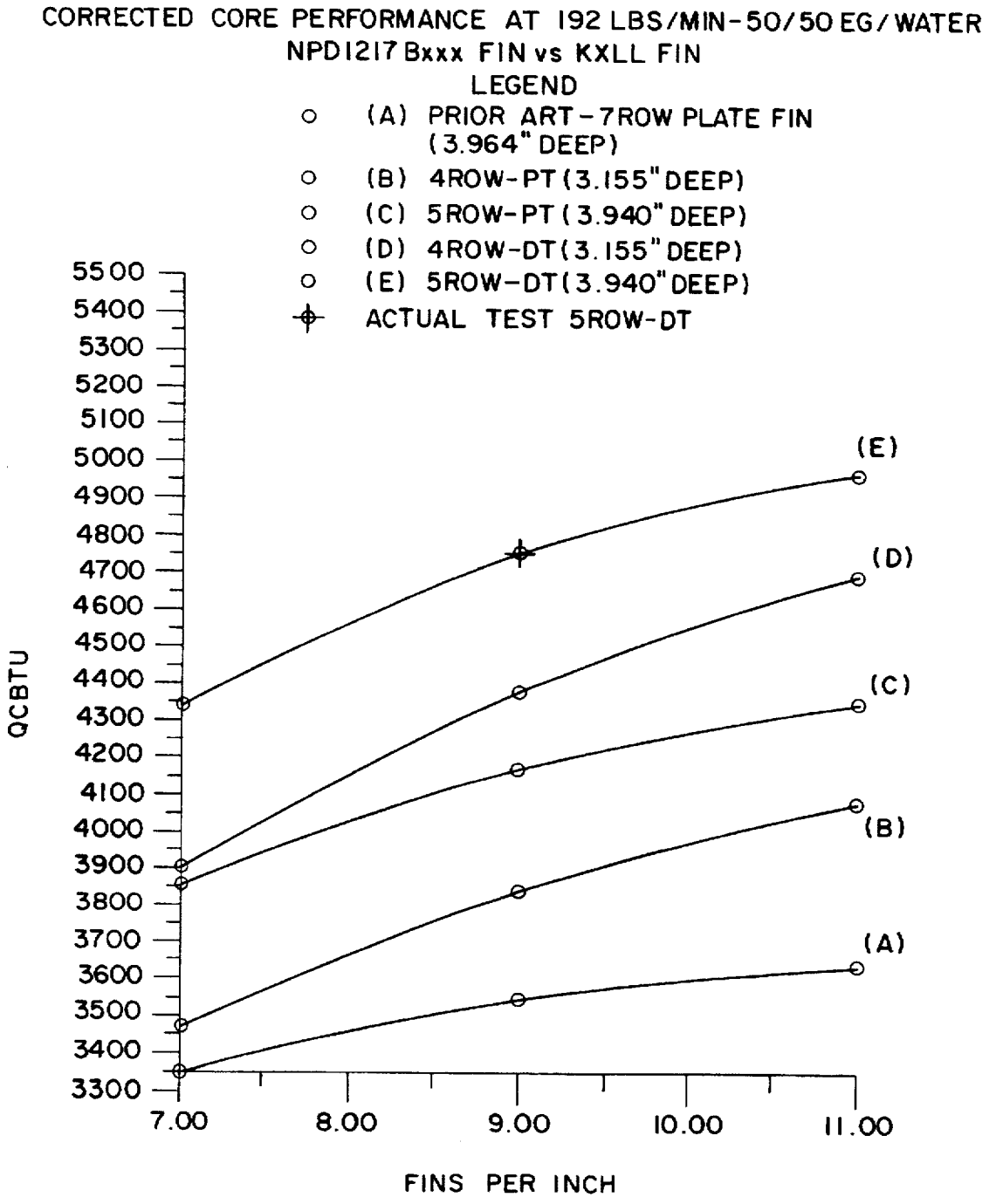
FIG. 11 depicts the same comparison as FIG. 10 for a 50/50 ethylene glycol/water mixture at a first flow rate.
Figure 12:
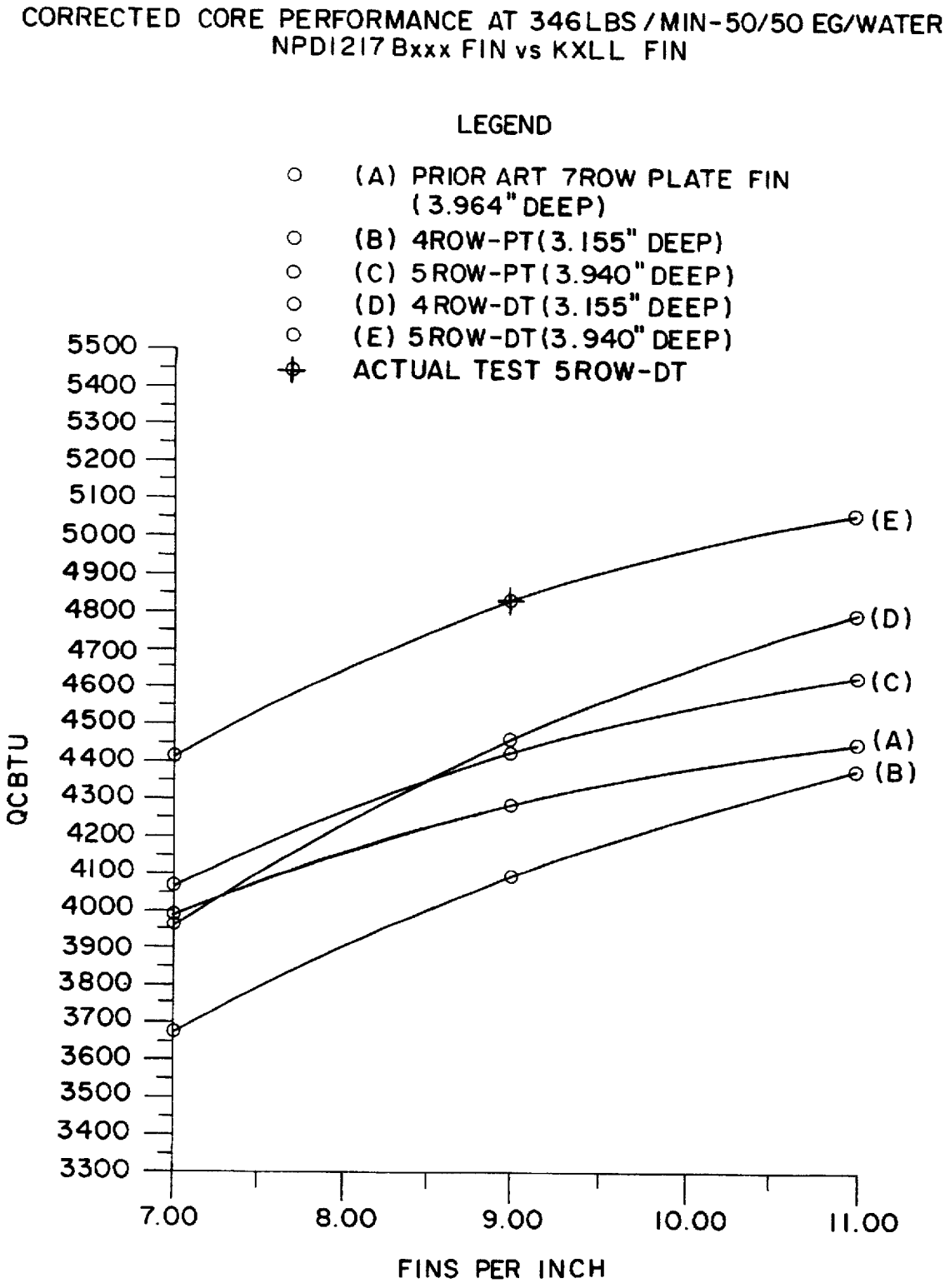
FIG. 12 depicts the same comparison as FIGS. 10 and 11 for a 50/50 ethylene glycol/water mixture at a second flow rate.

The improved heat transfer performance of the heat exchanger cores contemplated by this invention has been verified by computer heat transfer models and test results. The graphs in FIGS. 10–12 compare the core performance of heat exchangers having prior art plate fins (FIG. 1) with those having humped plate fins 20 herein described (FIG. 5).

Specifically, each graph compares the heat exchange performance of a heat exchanger constructed of a prior art seven-tube-row plate fin (curve A) with heat exchangers having four and five tube-row humped plate fins 20. The heat exchangers utilizing humped plate fins 20 had both plain tubes (PT) and dimpled tubes (DT) and are as follows:

| Curve | Heat Exchanger Contours |
|---|---|
| B | four tube row, plain tube |
| C | five tube row, plain tube |
| D | four tube row, dimpled tube |
| E | five tube row, dimpled tube |

Computer generated data points are shown as an "O" whereas data points taken from actual test data are shown by an "X".

Heat exchange performance is charted in FIGS. 10–12 in quality control btu(QCBTU). The QCBTU figure is obtained by adding together the amount of heat rejected at the operating point for each of three standard fan curves. The amount of heat rejected is based on an entering temperature potential of 100° F. where potential is defined as the difference between the average coolant temperature and the entering air temperature. The resulting QCBTU is a single figure representing an overall performance of the core and is expressed in BTU/min/Ft$^2$ face area at 100° F. potential. The type of fluid and the total fluid flow rate must be the same for each core type being compared.

It should be noted that for any given number of tube rows 24 and fins per inch (FPI), the heat transfer performance of cores having the humped plate fin element 20 exceeds the heat transfer performance of cores constructed with the prior art fin element 10. Additionally, as the number of fins per inch increases, the heat transfer performance of cores made with either fin increases. As the fins per inch numbers increase, the cores having the improved humped plate fin 20 construction show an increase in heat exchange performance of a greater rate than those having the prior art (FIG. 1) construction.

The data shows that the present humped plate fin element 20 achieves a higher heat transfer performance than prior art plate fins 10 at any given core configuration.

Further, FIGS. 10–12 show that at high water flow rate, the use of dimpled tubes improves performance slightly. FIG. 13 shows a flattened tube 12 having dimples 50 in one side and dimples 52 in the opposite side wall. The dimples 50 and 52 are concave to the exterior of the tubes. Moreover, the dimples 50 in one side wall are staggered with respect to the dimples 52 in the other side wall to force the heat exchange fluid within the tubes to follow a tortious path and to increase turbulence. However, when 50/50 ethylene glycol/water is used as the coolant, performance is increased substantially, especially at lower flow rates, by the use of dimpled tubes. These conclusions hold for whatever fin/tube combinations are used for the radiator.

These curves show that the manufacturer has several choices open to him when replacing a prior art radiator core with a core constructed of the present humped plate fins 20 to achieve the same or better performance. For example from FIG. 11, an 11 fins per inch prior art core having a flow rate of 192 lbs. per minute 50/50 ethylene glycol/water can be replaced with a 9 fins per inch 4 row plain tube core or a 7 fin per inch 5 row plain tube core. If a dimpled tube is used, both the number of fins per inch and number of tube rows could be further reduced. The resulting core would be thinner than the prior art core and would weigh less. It is also believed that production and transportation costs would be reduced.

From the foregoing it will be appreciated that a heat exchanger made up of a humped plate fins of the current invention offers many benefits over the prior art. First, the heat exchanger with a humped fin construction can be substituted for a prior art heat exchanger of the same size and weight and offer greater heat transfer performance than the prior art unit. Also, a humped fin heat exchanger with a given heat exchanger performance level will have a lower weight than an equally well performing prior art heat exchanger. Further, because the humped plate fin construction utilizes stiffening beads and not corrugations extending across the plate fin, the humped plate fin offers greater stability and stiffness than does the prior art plate fin. This attribute decreases core defects and delays that occur during heat exchanger construction. These stiffening beads may also increase the turbulence of the second fluid.

The foregoing disclosure of specific embodiments is intended to be illustrative of the broad concepts comprehended by the invention.

We claim:

1. A plate fin heat exchanger including a plurality of tubes and a plurality of plate fins, said plate fins comprising:

a plurality of arced deformations extending in at least two spaced rows substantially across the length of the plate fin, said arced deformations having a plurality of tube holes disposed therein; and a plurality of stiffening beads integral with the plate fin, said stiffening beads being disposed between said arced deformations, the stiffening beads comprising short and long stiffening beads.

2. The plate fin heat exchanger of claim 1 wherein each tube hole is surrounded by a collar.

3. The plate fin heat exchanger of claim 1 wherein the stiffening beads are raised from the plane of the plate fin.

4. The plate fin heat exchanger of claim 1 wherein said tubes are dimpled tubes.

5. A plate fin heat exchanger comprising a plurality of tubes and a plurality of plate fins, said plate fins comprising:

a plurality of arced deformations extending in at least two spaced rows substantially across the length of the plate fin, said arced deformations having a plurality of collared tube holes shaped to receive said tubes disposed therein; and a plurality of mutually transverse stiffening beads disposed in said fins between said rows of tube holes.

6. A plate fin heat exchanger comprising a plurality of tubes and a plurality of plate fins, said plate fins comprising:

a plurality of arced deformations extending in at least two spaced rows substantially across the length of the plate fin, said arced deformations having a plurality of oval shaped collared tube holes with major and minor axes sized to receive said tubes disposed therein, said holes being equally spaced along each row; and a plurality of stiffening beads of trapezoidal cross section disposed in a row between said rows of tube holes, said row of stiffening beads including long stiffening beads disposed lengthwise generally parallel to said major axis of said tube holes, further including short stiffening beads disposed lengthwise perpendicular to and between said long stiffening beads.

7. The plate fin heat exchanger of claim 6 wherein said short stiffening beads are disposed between said tube holes in adjacent tube rows, and said long stiffening beads are disposed between said adjacent arced rows.

8. The plate fin heat exchanger of claim 6 wherein said tubes are dimpled tubes.

* * * * *